US011486397B2

(12) United States Patent
Lee et al.

(10) Patent No.: US 11,486,397 B2
(45) Date of Patent: Nov. 1, 2022

(54) COMPRESSOR

(71) Applicant: LG Electronics Inc., Seoul (KR)

(72) Inventors: Seungmock Lee, Seoul (KR); Jonghun Ha, Seoul (KR); Cheolhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/274,031

(22) PCT Filed: Sep. 4, 2019

(86) PCT No.: PCT/KR2019/011390
§ 371 (c)(1),
(2) Date: Mar. 5, 2021

(87) PCT Pub. No.: WO2020/050618
PCT Pub. Date: Mar. 12, 2020

(65) Prior Publication Data

US 2021/0340984 A1 Nov. 4, 2021

(30) Foreign Application Priority Data

Sep. 5, 2018 (KR) ..... 10-2018-0106088

(51) Int. Cl.
*F04C 29/00* (2006.01)
*F04C 18/02* (2006.01)
*F04C 29/06* (2006.01)

(52) U.S. Cl.
CPC ..... *F04C 29/0057* (2013.01); *F04C 18/0215* (2013.01); *F04C 29/065* (2013.01); *F04C 2240/20* (2013.01); *F04C 2240/30* (2013.01); *F04C 2240/50* (2013.01); *F04C 2240/60* (2013.01); *F04C 2240/807* (2013.01)

(58) Field of Classification Search
CPC ..... F04C 18/0215; F04C 29/0057; F04C 29/065; F04C 29/0021; F04C 23/008; F04C 28/22; F04C 2240/20; F04C 2240/30; F04C 2240/50; F04C 2240/60; F04C 2240/807; F04C 2240/601
See application file for complete search history.

(56) References Cited

U.S. PATENT DOCUMENTS 4,838,773 A * 6/1989 Noboru ..... F04C 29/0021 418/57
7,175,402 B2 * 2/2007 Lee ..... F04C 29/0057 418/57

(Continued)

FOREIGN PATENT DOCUMENTS

JP H08165993 6/1996
KR 1019940001626 2/1994

(Continued)

OTHER PUBLICATIONS

Machine Translation JPH 08-165993 (Year: 2022).*

(Continued)

*Primary Examiner* — Audrey B. Walter
*Assistant Examiner* — Dapinder Singh
(74) *Attorney, Agent, or Firm* — Fish & Richardson P.C.

(57) ABSTRACT

Disclosed herein is a scroll compressor having a shaft balancer capable of attenuating vibration while preventing deformation of the rotary shaft during operation at a high speed.

11 Claims, 3 Drawing Sheets

(a)

(b)

(56) References Cited

U.S. PATENT DOCUMENTS

| | | | | |
|---|---|---|---|---|
| 8,992,188 | B2 * | 3/2015 | Nakamura | F04C 23/008 418/55.6 |
| 10,995,753 | B2 * | 5/2021 | Berning | F04C 18/0223 |
| 2017/0089341 | A1 * | 3/2017 | Takamura | F04C 23/008 |

FOREIGN PATENT DOCUMENTS

| | | |
|---|---|---|
| KR | 1019980024778 | 7/1998 |
| KR | 1020170091893 | 8/2017 |

OTHER PUBLICATIONS

Machine Translation KR 10-2017-0091893 (Year: 2022).*
PCT International Search Report and Written Opinion in International Appln. No. PCT/KR2019/011390, dated Dec. 30, 2019, 10 pages (English translation only).
KR Office Action in Korean Appln. No. 10-2018-0106088, dated Sep. 20, 2019, 12 pages (with English translation).
KR Notice of Allowance in Korean Appln. No. 10-2018-0106088, dated Nov. 29, 2019, 6 pages (with English translation).

* cited by examiner

[Fig. 1]
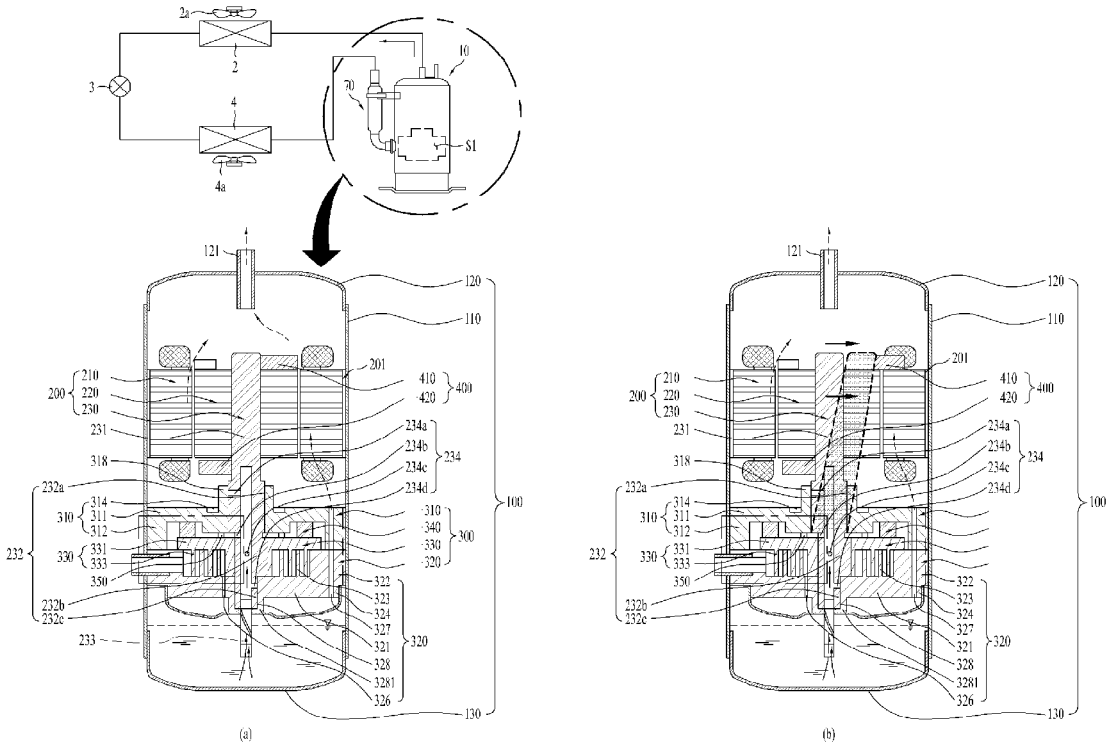
[Fig. 2]
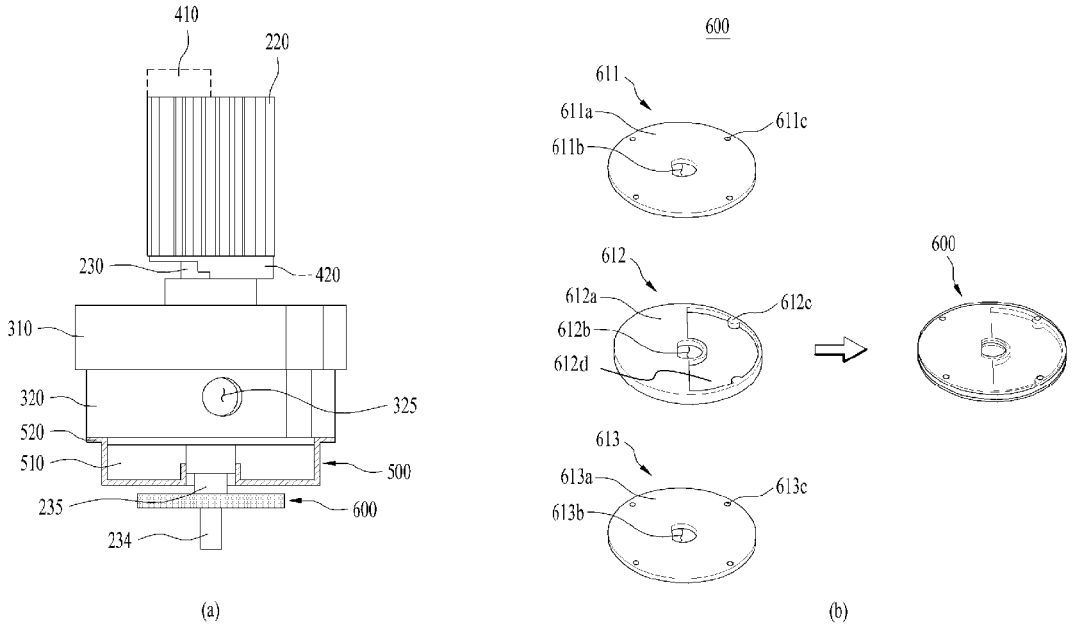

[Fig. 3]
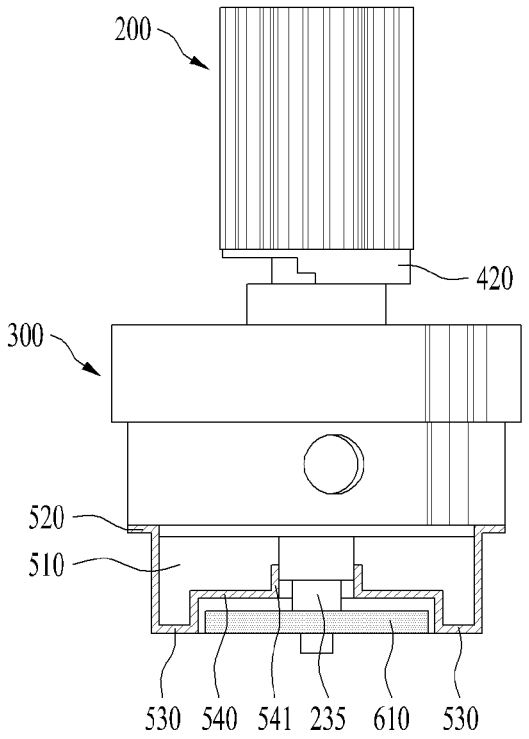
[Fig. 4]
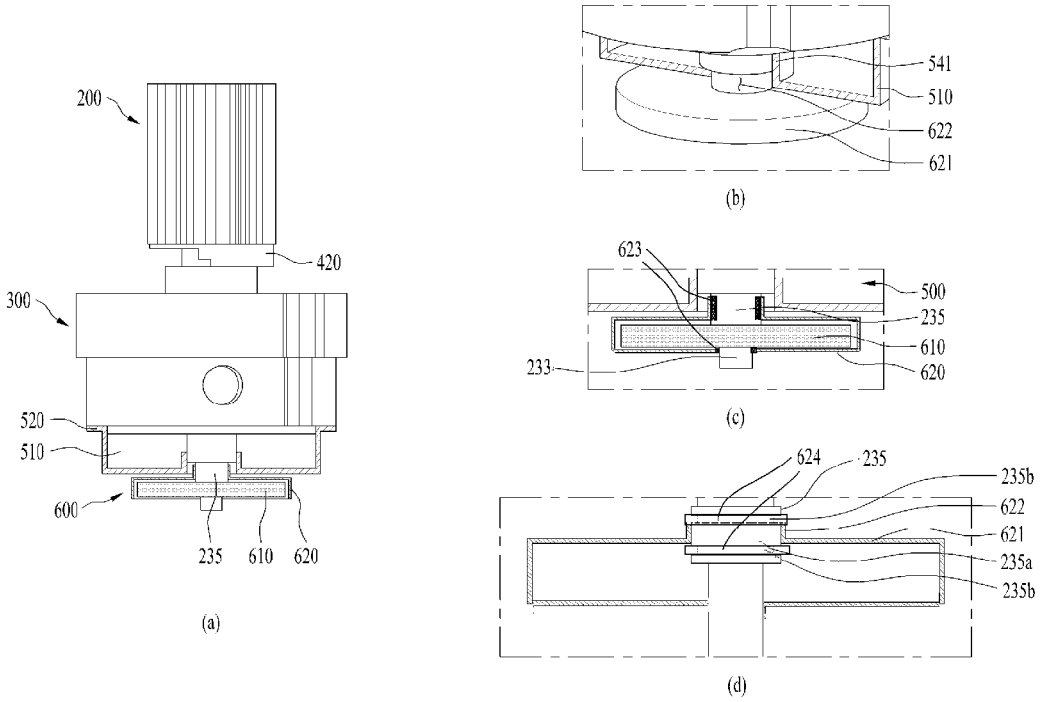

[Fig. 5]
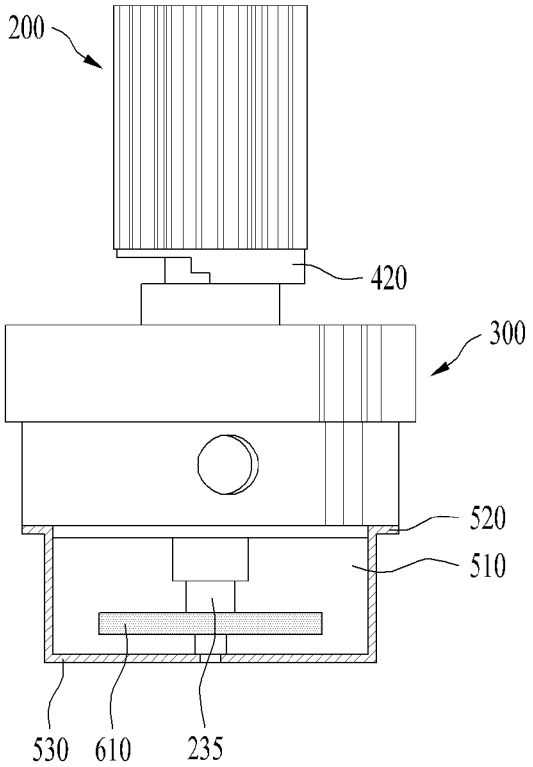
[Fig. 6]
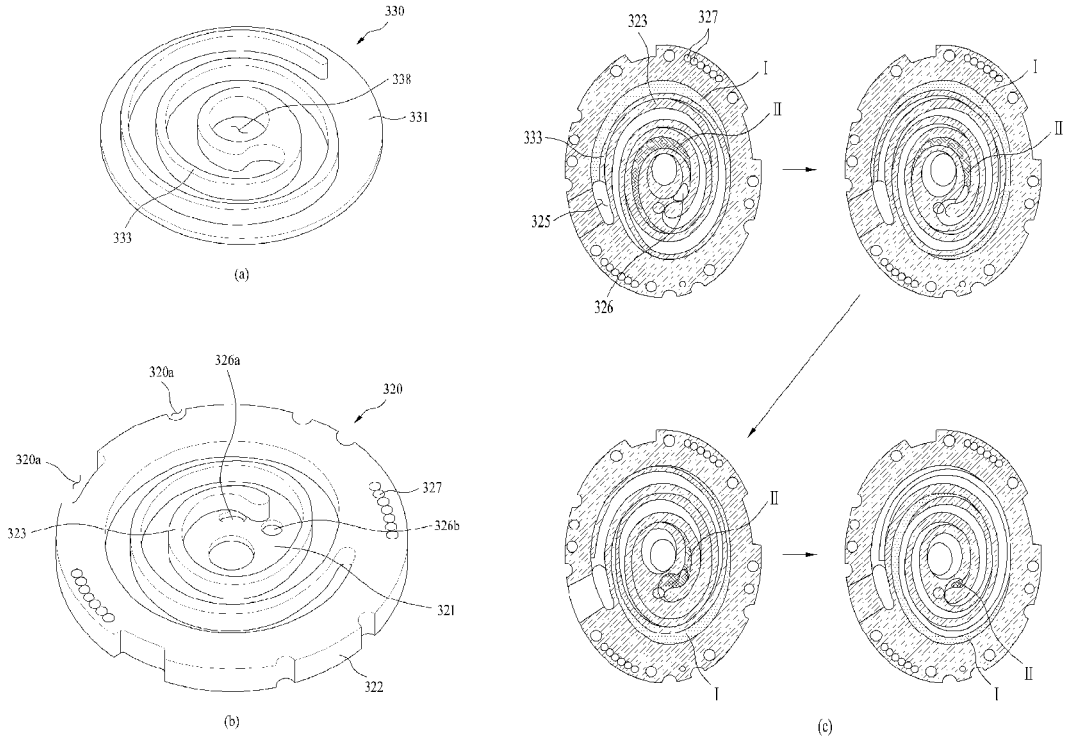

COMPRESSOR

CROSS-REFERENCE TO RELATED APPLICATIONS

This application is a National Stage application under 35 U.S.C. § 371 of International Application No. PCT/KR2019/011390, filed on Sep. 4, 2019, which claims the benefit of Korean Application No. 10-2018-0106088, filed on Sep. 5, 2018. The disclosures of the prior applications are incorporated by reference in their entirety.

TECHNICAL FIELD

The present invention relates to a compressor. More particularly, the present invention relates to a scroll compressor having a balancer capable of minimizing viscous resistance while preventing deformation of a rotary shaft rotating at a high speed.

BACKGROUND ART

Generally, a compressor is a device applied to a refrigeration cycle (hereinafter referred to simply as a refrigeration cycle) such as a refrigerator or an air conditioner. The compressor compresses the refrigerant to provide energy necessary for heat exchange in the refrigeration cycle.

Compressors can be divided into reciprocating compressors, rotary compressors, and scroll compressors according to how the refrigerant is compressed. The scroll compressor is a compressor in which an orbiting scroll is pivotably engaged with a fixed scroll fixed in the inner space of a hermetically sealed container to form a compression chamber between a fixed lap of the fixed scroll and an orbiting lap of the orbiting scroll.

Scroll compressors perform a compression operation continuously through scroll shapes engaged with each other, and thus can obtain a higher compression ratio than other types of compressors, and also obtain stable torque because the intake, compression, and discharge operations of the refrigerant are smoothly connected. For this reason, scroll compressors are widely used for refrigerant compression in air conditioners and the like.

The conventional scroll compressor includes a case defining an outer appearance thereof and having a discharge portion allowing a refrigerant to be discharged therethrough, a compression unit fixed to the case and configured to compress the refrigerant, and a drive unit is fixed to the case and configured to drive the compression unit. Here, the compression unit and the drive unit are connected by a rotary shaft, which is rotatably coupled to the drive unit.

The compression unit includes a fixed scroll fixed to the case and having a fixed lap, and an orbiting scroll including an orbiting lap engaged with the fixed lap and driven by the rotary shaft. In the case of the conventional scroll compressor, the rotary shaft is eccentrically arranged, and the orbiting scroll is rotatably fixed to the eccentric rotary shaft. Thus, the orbiting scroll compresses the refrigerant while revolving (orbiting) around the fixed scroll.

However, in such a conventional scroll compressor, in order to revolve the orbiting scroll, the rotary shaft rotates while being eccentrically arranged. Therefore, the conventional scroll compressor further includes a balancer to offset the bending moment and vibration occurring due to the eccentricity of the rotary shaft.

The balancer may be formed of metal such as iron having a predetermined level of eccentric load biased against the rotary shaft to compensate for the eccentricity of the rotary shaft. The balancer can be directly coupled to the drive unit to compensate for the eccentricity of the rotary shaft.

Generally, in the conventional scroll compressor, the compression unit is disposed under the discharge portion, and the drive unit is disposed under the compression unit. The rotary shaft is disposed with one end coupled to the compression unit and the opposite end arranged through the drive unit in a penetrating manner.

However, the conventional scroll compressor has difficulty in supplying oil to the compression unit because the compression unit is disposed above the drive unit and is positioned close to the discharge portion, and additionally a lower frame needs to be arranged under the drive unit to separately support the rotary shaft connected to the compression unit.

In addition, since the points of action of the gas force generated by the refrigerant inside the compressor and the reaction force supporting the same do not coincide with each other, the scroll is tilted. Thereby, the efficiency and reliability of the conventional scroll compressor can be deteriorated.

Recently, in order to address this issue, a scroll compressor (a so-called lower scroll compressor) in which the drive unit is disposed under the discharge portion and the compression unit is disposed under the drive unit has been introduced.

In the case of the lower scroll compressor, the drive unit is arranged ahead of the compression unit toward the discharge portion, and the compression unit is arranged farthest away from the discharge portion.

In the lower scroll compressor, one end of the rotary shaft is connected to the drive unit, and the opposite end of the rotary shaft is supported by the compression unit. Thus, the lower frame is omitted, and oil stored in the lower part of the case can be directly supplied to the compression unit without passing through the drive unit. In addition, when the rotary shaft is connected through the compression unit in the scroll compressor, the points of action of the gas force and the reaction force coincide with each other on the rotary shaft, and therefore the efficiency and reliability can be ensured by offsetting the tilting or turnover moment on the scroll.

However, even when the rotary shaft is arranged through the compression unit in the lower scroll compressor in a penetrating manner such that one end thereof is supported, the opposite end of the rotary shaft is coupled to a rotor rotatably arranged in the drive unit. Therefore, even though the portion coupled to the compression unit is provided as a fixed end, the portion coupled to the drive unit is provided as a free end.

In this case, even if the scroll compressor includes a balancer coupled to the drive unit to compensate for eccentricity of the rotary shaft, the load of the balancer may act as a cause of generating a bending moment on the rotary shaft.

Thus, when the rotary shaft rotates at a high speed, the balancer, which may sufficiently compensate for the eccentricity of the rotary shaft when the rotary shaft rotates at a low speed, may act as a heavy load on the free end of the rotary shaft, thereby bending the free end of the rotary shaft.

In addition, as the load of the balancer as well as the load of the drive unit is applied to the free end of the rotary shaft, the load is excessively concentrated on the free end of the rotary shaft. As a result, during operation of the conventional lower scroll compressor, more excessive vibration may occur or the rotary shaft may be easily bent due to the balancer.

DISCLOSURE OF INVENTION

Technical Problem

An object of the present invention is to provide a scroll compressor capable of preventing load from being concentrated on one end of a rotary shaft.

Another object of the present invention is to provide a scroll compressor capable of compensating for eccentricity of the rotary shaft whether the rotary shaft is rotated at a low speed or a high speed.

Another object of the present invention is to provide a scroll compressor provided with a balancer capable of compensating for even the load of a drive unit.

Another object of the present invention is to provide a compressor capable of minimizing viscous resistance of a refrigerant or oil even when a balancer rotates at a high speed.

Solution to Problem

The objects of the present invention can be achieved by providing a compressor including a case having a discharge portion provided on one side thereof to discharge a refrigerant, a drive unit including a stator coupled to an inner circumferential surface of the case to generate a rotating magnetic field, and a rotor accommodated in the stator so as to be rotated by the rotating magnetic field, a rotary shaft coupled to a side of the rotor facing away from the discharge portion and including an eccentric shaft biased toward the case, a compression unit including an orbiting scroll coupled to the eccentric shaft to make an orbital movement when the rotary shaft rotates, and a fixed scroll engaged with the orbiting scroll to receive and compress the refrigerant, a muffler coupled to a side of the compression unit facing away from the discharge portion and configured to guide the refrigerant to the discharge portion, a balancer provided to at least one of the drive unit and the rotary shaft to offset or distribute a load of the eccentric shaft.

The balancer may include a shaft balancer rotatably coupled to the rotary shaft protruding from the compression unit in a direction away from the discharge portion.

The shaft balancer may include an eccentric portion coupled to the rotary shaft to rotate together with the rotary shaft.

The eccentric portion may include a load body formed in a plate shape, a load through hole formed through the load body in a penetrating manner and coupled to the rotary shaft, and a balancing portion provided by cutting away or concavely forming a part of the load body.

The compressor may further include a cover coupled to the load body to shield the balancing portion.

The muffler may accommodate the shaft balancer to prevent a part or entirety of an outer circumferential surface of the shaft balancer from being exposed.

The muffler may include a coupling portion coupled to the fixed scroll, an accommodation body extending from the coupling portion to define a space allowing the refrigerant to flow therein, and a recess formed on one surface of the accommodation body so as to be concave toward the discharge portion, wherein the shaft balancer may be seated in the recess.

The accommodation body and an exposed surface of the shaft balancer may be arranged parallel to each other.

The shaft balancer may further include a housing coupled to the rotary shaft to accommodate the eccentric portion.

The housing may be coupled to the rotary shaft so as to be rotatable in a direction opposite to rotation of the rotary shaft.

The housing may include a housing body configured to completely accommodate the eccentric portion, a housing shaft support portion provided to the housing body to surround an outer circumferential surface of the rotary shaft, the housing shaft support portion and the rotary shaft being prevented from rotating simultaneously.

The housing shaft support portion may be fixed to either the muffler or the fixed scroll.

The compressor of claim 10, wherein the rotary shaft may include a contact portion arranged on an inner circumferential surface of the housing shaft support portion, a recess portion provided to at least one of an upper portion and a lower portion of the contact portion, the recess portion having a smaller diameter than the contact portion, and a coupling ring coupled to the recess portion to prevent axial movement of the housing shaft support portion.

The coupling ring may be formed of a self-lubricative material.

The compressor may further include a rotational bearing arranged between the housing shaft support portion and the rotary shaft to rotatably support the rotary shaft.

The shaft balancer may be completely accommodated in the muffler.

An inner circumferential surface of the accommodation body and an outer circumferential surface of the shaft balancer may be spaced apart from each other.

Advantageous Effects of Invention

According to embodiments of the present invention, a scroll compressor may prevent load from being concentrated on one end of a rotary shaft.

According to embodiments of the present invention, a scroll compressor capable may compensate for eccentricity of the rotary shaft whether the rotary shaft is rotated at a low speed or a high speed.

According to embodiments of the present invention, a scroll compressor is provided with a balancer which may compensate for even the load of a drive unit According to embodiments of the present invention, a compressor may minimize viscous resistance of a refrigerant or oil even when a balancer rotates at a high speed.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 shows a configuration of a scroll compressor;

FIG. 2 shows the structure of a scroll compressor and a shaft balancer according to the present invention;

FIG. 3 shows an embodiment of the shaft balancer according to the present invention;

FIG. 4 shows another embodiment of the shaft balancer according to the present invention;

FIG. 5 shows yet another embodiment of the shaft balancer according to the present invention; and FIG. 6 illustrates the principle of operation of the scroll compressor according to the present invention.

BEST MODE FOR CARRYING OUT THE INVENTION

Hereinafter, embodiments of the present disclosure will be described in detail with reference to the accompanying drawings. In the present disclosure, the same or similar reference numerals are given to the same or similar components in different embodiments, and the redundant description thereof is omitted. As used herein, the singular forms "a", "an" and "the" include plural referents unless the context clearly dictates otherwise. In the following description of the embodiments of the present disclosure, a detailed description of known technology will be omitted will be omitted for the purpose of clarity and brevity. In addition, it should be noted that the accompanying drawings are included to provide a further understanding of the embodiments of the present disclosure. The accompanying drawings should not be construed as limiting the technical idea of the present disclosure.

FIG. 1 shows a refrigeration cycle 1 to which a scroll compressor according to the present invention is applied. Referring to FIG. 1, Referring to FIG. 1, a refrigeration cycle apparatus to which a lower scroll compressor 10 is applicable may include the lower scroll compressor 10, a condenser 2 and a condensing fan 2*a*, an expander 3, an evaporator 4 and an evaporation fan 4*a*, which constitute a closed loop.

The scroll compressor 10 may include a case 100 having a space in which a fluid is stored or flows, a drive unit 200 coupled to an inner circumferential surface of the case 100 to rotate a rotary shaft 230, and a compression unit 300 coupled to the rotary shaft 230 in the case to compress the fluid.

Specifically, a discharge portion 121 through which a refrigerant is discharged may be provided on one side of the case 100. The case 100 may include an accommodation shell 110 formed in a cylindrical shape to accommodate the drive unit 200 and the compression unit 300, and a discharge shell 120 coupled to one end of the accommodation shell 110 and provided with the discharge portion 121, and a shielding shell 130 coupled to the opposite end of the accommodation shell 110 to seal the accommodation shell 110.

The drive unit 200 includes a stator 210 configured to generate a rotating field, and a rotor 220 arranged to be rotated by the rotating field. The rotary shaft 230 may be coupled to the rotor 220 to rotate together with the rotor 220.

The stator 210 may have multiple slots formed in the inner circumferential surface thereof in a circumferential direction such that a coil is wound on the stator 210, and may be fixed to the inner circumferential surface of the accommodating shell 110. The rotor 220 may be coupled with a permanent magnet and be rotatably coupled to the inside of the stator 210 to generate rotational power. The rotary shaft 230 may be press-fitted into the center of the rotor 220.

The compression unit 300 may include a fixed scroll 320 coupled to the accommodation shell 110 and arranged on a side of the drive unit 200 facing away from the discharge portion 121, an orbiting scroll 330 coupled to the rotary shaft 230 to engage with the fixed scroll 320 to form a compression chamber, and a main frame 310 formed to accommodate the orbiting scroll 330 and seated on the fixed scroll 320 to define an outer appearance of the compression unit 300.

As a result, in the scroll compressor 10, the drive unit 200 is disposed between the discharge portion 121 and the compression unit 300. In other words, the drive unit 200 may be provided on one side of the discharge portion 121 and the compression unit 300 may be provided on the drive unit 200 in a direction away from the discharge portion 121. For example, when the discharge portion 121 is provided in the upper portion of the case 100, the compression unit 300 may be arranged under the drive unit 200, and the drive unit 200 may be arranged between the discharge portion 121 and the compression unit 300.

Thus, when oil is stored on the bottom surface of the case 100, the oil may be supplied directly to the compression unit 300 without passing through the drive unit 200. In addition, since the rotary shaft 230 is coupled to and supported by the compression unit 300, a separate lower frame by which the rotary shaft is rotatably supported may be omitted.

In the scroll compressor 10 of the present invention, the rotary shaft 230 may make surface contact not only with the orbiting scroll 330 but also with the fixed scroll 320 by passing through the fixed scroll 320.

Thus, the inflow force generated when a fluid such as a refrigerant flows into the compression unit 300, and the gas force generated when the refrigerant is compressed in the compression unit 300 and the reaction force supporting the gas force may be applied directly to the rotary shaft 230. Accordingly, the inflow force, gas force, and reaction force may be applied to the rotary shaft 230 at one point of action. Thus, the turnover moment may not act on the orbiting scroll 330 coupled to the rotary shaft 230, and therefore the orbiting scroll may be prevented from being tilted or overturned. In other words, tilting including axial vibration occurring in the orbiting scroll 330 may be attenuated or prevented, and the turnover moment of the orbiting scroll 330 may also be attenuated or suppressed. As a result, noise and vibration generated by the scroll compressor 10 may be blocked.

In addition, since the fixed scroll 320 supports the rotary shaft 230 by surface contact, the durability of the rotary shaft 230 may be reinforced even when the inflow force and the gas force act on the rotary shaft 230.

Further, the rotary shaft 230 may partially absorb or support the back pressure generated when the refrigerant is discharged to the outside, thereby reducing the force (normal force) that excessively brings the orbiting scroll 330 and the fixed scroll 320 into close contact with each other in the axial direction. As a result, the friction between the orbiting scroll 330 and the fixed scroll 320 may be greatly reduced.

As a result, the compressor 10 of the present invention may reduce the axial shaking and turnover moment of the orbiting scroll 330 in the compression unit 300 and the frictional force against the orbiting scroll 300, thereby improving efficiency and reliability.

The main frame 310 of the compression unit 300 may include a main head plate 311 arranged on one side of the drive unit 200 or under the drive unit 200, a main side plate 312 extending from an inner circumferential surface of the main head plate 311 in a direction away from the drive unit 200 and seated on the fixed scroll 330, and a main shaft support portion 318 extending from the main head plate 311 to rotatably support the rotary shaft 230.

The main head plate 311 or the main side plate 312 may further include a main hole for guiding the refrigerant discharged from the fixed scroll 320 to the discharge portion 121.

The main head plate 311 may further include an oil pocket 314 formed at the exterior of the main shaft support portion 318 in a recessed manner. The oil pocket 314 may be formed in an annular shape and eccentrically disposed in the main shaft support portion 318. The oil pocket 314 may be formed such that, when the oil stored in the shielding shell 130 is delivered through the rotary shaft 230 or the like, the oil is supplied to parts of the fixed scroll 320 and the orbiting scroll 330 that engage with each other.

The fixed scroll 320 may include a fixed head plate 321 coupled to the accommodation shell 110 on a side of the main head plate 311 facing away from the drive unit 200 to form the opposite surface of the compression unit 300, a fixed side plate 322 extending from the fixed head plate 321 toward the discharge portion 121 so as to contact the main side plate 312, and a fixed lap 323 formed on the inner circumferential surface of the fixed side plate 322 to define a compression chamber in which the refrigerant is compressed.

The fixed scroll 320 may include a fixed through hole 328 through which the rotary shaft 230 is arranged, and a fixed shaft support portion 3281 extending from the fixed through hole 328 to rotatably support the rotary shaft. The fixed shaft support portion 3281 may be provided at the center of the fixed head plate 321.

The thickness of the fixed head plate 321 may be the same as the thickness of the fixed shaft support portion 3281. Here, the fixed shaft support portion 3281 may not protrude from the fixed head plate 321, but may be inserted into the fixed through hole 328.

The fixed side plate 322 may be provided with an introduction hole 325 for introducing the refrigerant into the fixed lap 323, and the fixed head plate 321 may be provided with a discharge hole 326 through which the refrigerant is discharged. The discharge hole 326 may be arranged close to the center of the fixed lap 323, and may be spaced apart from the fixed shaft support portion 3281 in order to avoid interference with the fixed shaft support portion 3281. The discharge hole may include a plurality of discharge holes.

The orbiting scroll 330 may include an orbiting head plate 331 arranged between the main frame 310 and the fixed scroll 320, and an orbiting lap 331 arranged to define the compression chamber in cooperation with the fixed lap 323 on the orbiting head plate 331.

The orbiting scroll 330 may further include an orbiting through hole 338 formed through the orbiting head plate 331 such that the rotary shaft 230 is rotatably coupled to the orbiting through hole.

The rotary shaft 230 may be formed such that a part thereof coupled to the orbiting passage hole 338 is eccentrically arranged. Accordingly, when the rotary shaft 230 rotates, the orbiting scroll 330 may move along the fixed lap 323 of the fixed scroll 320 in engagement with the fixed scroll 320 to compress the refrigerant.

Specifically, the rotary shaft 230 may include a main shaft 231 rotated by the drive unit 200 and a bearing unit 232 connected to the main shaft 231 so as to be rotatably coupled to the main shaft 231. The bearing part 232 may be provided as a member separate from the main shaft 231 to accommodate the main shaft 231 therein, or may be integrated with the main shaft 231.

The bearing unit 232 may include a main bearing portion 232*a* inserted into and radially supported by the main shaft support portion 318 of the main frame 310, a fixed bearing portion 232*c* inserted into and radially supported by the fixed shaft support portion 3281 of the fixed scroll 320, and an eccentric shaft 232*b* arranged between the main bearing portion 232*a* and the fixed bearing portion 232*c* and inserted into the orbiting through hole 338 of the orbiting scroll 330.

Here, the main bearing portion 232*a* and the fixed bearing portion 232*c* may be coaxially arranged so as to have the same center of axis, and the center of gravity of the eccentric portion 232*b* may be arranged so as to be radially eccentric with respect to the main bearing portion 232*a* or the fixed bearing portion 232*a*. In addition, the eccentric shaft 232*b* may have an outer diameter larger than an outer diameter of the main bearing portion 232*a* and an outer diameter of the fixed bearing portion 232*a*. Thus, when the bearing unit 232 rotates, the eccentric shaft 232*b* may provide force for compressing the refrigerant while causing the orbiting scroll 330 to make a revolving movement. In addition, the eccentric shaft 232*b* may cause the orbiting scroll 330 to regularly make an orbiting movement on the fixed scroll 320.

To prevent the orbiting scroll 330 from rotating on its own axis, the compressor 10 of the present invention may further include an Oldham's ring 340 coupled to an upper portion of the orbiting scroll 330. The Oldham's ring 340 may be arranged between the orbiting scroll 330 and the main frame 310 so as to contact both the orbiting scroll 330 and the main frame 310. The Oldham's ring 340 may be arranged to linearly move in four directions of front, rear, left and right to prevent the orbiting scroll 330 from rotating on its own axis.

The rotary shaft 230 may be arranged to protrude from the compression unit 300 by completely passing through the fixed scroll 320. As a result, the exterior of the compression unit 300, the oil stored in the shielding shell 130, and the rotary shaft 230 may directly contact each other, and the oil may be supplied into the compression unit 300 when the rotary shaft 230 rotates.

The oil may be supplied to the compression unit 300 through the rotary shaft 230.

The rotary shaft 230 may be provided therein with an oil supply passage 234 for supplying the oil to the outer circumferential surface of the main bearing portion 232*c*, the outer circumferential surface of the fixed bearing portion 232*a*, and the outer circumferential surface of the eccentric shaft 232*b*.

In addition, a plurality of oil holes 234*a*, 234*b*, 234*c*, and 234*d* may be formed in the oil supply passage 234. Specifically, the oil holes may include a first oil hole 234*a*, a second oil hole 234*b*, a third oil hole 234*d*, and a fourth oil hole 234*e*. The first oil hole 234*a* may be formed through the outer circumferential surface of the main bearing portion 232*c*.

Specifically, the first oil hole 234*a* may extend from the oil supply passage 234 to the outer circumferential surface of the main bearing portion 232*a* in a penetrating manner. Further, the first oil hole 234*a* may be formed through an upper portion of the outer circumferential surface of the main bearing portion 232*a* in a penetrating manner, but embodiments are not limited thereto. That is, it may be formed through a lower portion of the outer circumferential surface of the main bearing portion 232*a* in a penetrating manner. For reference, For reference, the first oil hole 234*a* may include a plurality of holes, unlike the one shown in the drawing. When the first oil hole 234*a* includes a plurality of holes, the holes may be formed only in the upper or lower portion of the outer circumferential surface of the main bearing portion 232*c*, or may be formed in both the upper and lower portions of the outer circumferential surface of the main bearing portion 232*c*.

The rotary shaft 230 may include an oil feeder 233 arranged through a muffler 500, which will be described later, to contact the oil stored in the case 100. The oil feeder 233 may include an extension shaft 233*a* arranged through the muffler 500 to contact the oil, and a spiral groove 233*b* formed on the outer circumferential surface of the extension shaft 233*a* in a spiral shape to communicate with the supply passage 234.

Accordingly, when the rotary shaft 230 rotates, the oil rises through the oil feeder 233 and the supply passage 234 due to the spiral groove 233*b*, the viscosity of the oil, and a difference in pressure between the high-pressure area and the intermediate-pressure area in the compression unit 300, and is then discharged through the plurality of oil holes. The oil discharged through the plurality of oil holes 234*a*, 234*b*, 234*d* and 234*e* may form an oil film between the fixed scroll 250 and the orbiting scroll 240 to maintain the airtight state, and may absorb and dissipate heat generated by friction between components of the compression unit 300.

The oil guided along the rotary shaft 230 may be supplied through the first oil hole 234*a* to lubricate the main frame 310 and the rotary shaft 230. In addition, the oil may be discharged through the second oil hole 234*b* and supplied to the top surface of the orbiting scroll 240. The oil supplied to the top surface of the orbiting scroll 240 may be guided to an intermediate-pressure chamber through the oil pocket 314. For reference, the oil discharged through the first oil hole 234*a* or the third oil hole 234*d* as well as the second oil hole 234*b* may be supplied to the oil pocket 314.

The oil guided along the rotary shaft 230 may be supplied to the Oldham's ring 340, which is arranged between the orbiting scroll 240 and the main frame 230, and the fixed side plate 322 of the fixed scroll 320. Thereby, wear of the fixed side plate 322 of the fixed scroll 320 and the Oldham's ring 340 may be reduced. In addition, the oil supplied to the third oil hole 234*c* may be supplied to the compression chamber, thereby reducing wear of the orbiting scroll 330 and the fixed scroll 320 caused by friction therebetween. Further, the oil may form an oil film and dissipate heat, thereby improving the compression efficiency.

While the scroll compressor 10 is illustrated as having a centrifugal oil supply structure in which oil is supplied to the bearings using rotation of the rotary shaft 230, this is merely an embodiment. The compressor 10 may employ a differential pressure oil supply structure in which oil is supplied using the difference in pressure in the compressor 300, and a forced oil supply structure in which oil is supplied through a trochoid pump or the like.

The compressed refrigerant is discharged to the discharge hole 326 along the space defined by the fixed lap 323 and the orbiting lap 333. It may be more advantageous to arrange the discharge hole 326 to face the discharge portion 121. This is because the refrigerant discharged from the discharge hole 326 can be discharged to the discharge portion 121 without undergoing a significant change in flow direction.

However, since the compression unit 300 is arranged on the side of the drive unit 200 facing away from the discharge portion 121 and the fixed scroll 320 should be arranged at the outermost side of the compression unit 300, the refrigerant is sprayed from the discharge hole 326 in a direction away from the discharge portion 121.

In other words, the discharge hole 326 is formed in the fixed head plate 321 to discharge the refrigerant in the direction away from the discharge portion 121. If the refrigerant is directly sprayed into the discharge hole 326, the refrigerant may not be smoothly discharged to the discharge portion 121. Further, if there is oil stored in the shielding shell 130, there is a possibility that the refrigerant is cooled by or mixed with the oil.

In order to prevent such issues, the compressor 10 may further include a muffler 500 coupled to an outermost portion of the fixed scroll 320 to provide a space for guiding the refrigerant to the discharge portion 121.

The muffler 500 may be arranged to seal one surface of the fixed scroll 320 arranged on a side facing away from the discharge portion 121 so as to guide the refrigerant discharged from the fixed scroll 320 to the discharge portion 121.

The muffler 500 include a coupling body 520 coupled to the fixed scroll 320, and an accommodation body 510 extending from the coupling body 520 to define a sealed space. Thus, the refrigerant sprayed through the discharge hole 326 may be discharged to the discharge portion 121 as the flow direction thereof is changed along the sealed space defined by the muffler 500.

Since the fixed scroll 320 is coupled to the accommodation shell 110, the refrigerant may be restricted from moving to the discharge portion 121 due to the interference of the fixed scroll 320. Accordingly, the fixed scroll 320 may further include a bypass hole 327 allowing the refrigerant passing through the fixed head plate 321 to pass through the fixed scroll 320. The bypass hole 327 may be formed to communicate with the main hole 327. Accordingly, the refrigerant may pass through the compression unit 300 and be discharged to the discharge portion 121 via the drive unit 200.

Since the refrigerant is compressed at a higher pressure inside the fixed lap 323 than on the outer circumferential surface of the fixed lap 323, the inside of the fixed lap 323 and the turning lap 333 is maintained at a high pressure. Therefore, the discharge pressure is applied to the back surface of the orbiting scroll, and the back pressure acts from the orbiting scroll toward the fixed scroll as a reaction. The compressor 10 of the present invention may further include a back pressure seal 350 configured to concentrate the back pressure on coupling portions of the orbiting scroll 330 and the rotary shaft 230 coupled to each other to prevent leakage through a gap between the orbiting lap 333 and the fixed lap 323.

The back pressure seal 350 is formed in a ring shape to maintain the inner circumferential surface thereof at a high pressure and separate the outer circumferential surface thereof at an intermediate pressure lower than the high pressure. Therefore, the back pressure is concentrated on the inner circumferential surface of the back pressure seal 350 so as to bring the orbiting scroll 330 into close contact with the fixed scroll 320.

In this case, considering that the discharge hole 326 is arranged spaced apart from the rotary shaft 230, the back pressure seal 350 may also be arranged such that the center thereof is biased toward the discharge hole 326. The oil supplied to the compression unit 300 or the oil stored in the case 100 may move to the upper portion of the case 100 together with the refrigerant as the refrigerant is discharged to the discharge portion 121. At this time, the oil is denser than the refrigerant. Accordingly, the oil does not move to the discharge portion 121 due to the centrifugal force generated by the rotor 220, and sticks to the inner walls of the discharge shell 110 and the accommodating shell 120. In the scroll compressor 10, the drive unit 200 and the compression unit 300 may be provided with a recovery passage on the outer circumferential surface thereof to return the oil stuck to the inner wall of the case 100 to the oil reservoir space of the case 100 or the shielding shell 130.

The recovery passage may include a drive recovery passage 201 provided on the outer circumferential surface of the drive unit 200, a compression recovery passage 301 provided on the outer circumferential surface of the compression unit 300, and a muffler recovery passage 501 provided on the outer circumferential surface of the muffler 500.

The drive recovery passage 201 may be formed by denting a part of the outer circumferential surface of the stator 210, and the compression recovery passage 301 may be formed by denting a part of the outer circumferential surface of the fixed scroll 320. In addition, the muffler recovery passage 501 may be formed by denting a part of the outer circumferential surface of the muffler. The drive recovery passage 201, the compression recovery passage 301, and the muffler recovery passage 501 may communicate with each other to allow oil to pass therethrough.

As described above, since the center of gravity of the rotary shaft 230 is biased to one side due to the eccentric shaft 232*b*, an unbalanced eccentric moment may be generated during rotation, thereby causing the overall balance to be lost. Accordingly, the scroll compressor 10 of the present invention may further include a balancer 400 capable of offsetting the eccentric moment that may occur due to the eccentric shaft 232*b*.

Since the compression unit 300 is fixed to the case 100, the balancer 400 is preferably coupled to the rotary shaft 230 that is rotatably arranged or the rotor 220. Accordingly, the balancer 400 is provided with a central balancer 420 provided to a lower end of the rotor 220 or one surface of the rotor 220 facing the compression unit 300 so as to offset or reduce the eccentric load of the eccentric shaft 232*b*, and an outer balancer coupled to the upper end of the rotor 220 or the opposite surface of the rotor 220 facing the discharge portion 121 to offset the eccentric load or the eccentric moment of at least one of the eccentric shaft 232*b* or the lower balancer 420.

Since the central balancer 420 is arranged relatively close to the eccentric shaft 232*b*, the central balancer 420 may directly offset the eccentric load of the eccentric shaft 232*b*. Therefore, the central balancer 420 may be eccentrically positioned to a side opposite to the side to which the eccentric shaft 232*b* is eccentrically positioned. As a result, whether the rotary shaft 230 rotates at a low speed or a high speed, the central balancer may almost uniformly and effectively offset the eccentric force or the eccentric load generated by the eccentric shaft 232*b* because the distance thereof from the eccentric shaft 232*b* is short.

The outer balancer 410 may be eccentrically positioned to a side opposite to the side to which the eccentric shaft 232*b* is eccentrically positioned. However, the outer balancer 410 may be eccentrically arranged on a side corresponding to the eccentric shaft 232*b* to partially offset the eccentric load generated by the central balancer 420.

Thus, the central balancer 420 and the outer balancer 410 may assist the rotary shaft 230 in stably rotating by offsetting the eccentric moment generated due to the eccentric shaft 232*b*.

In the scroll compressor, the fixed lap 323 and the orbiting lap 333 radially extend in a logarithmic spiral shape or an involute shape about the center of the fixed scroll 320. Accordingly, the highest pressure is applied to the center of the fixed scroll 320, and thus the discharge hole 326 is provided at the center.

However, in the scroll compressor 10 of the present invention, the fixed lap 323 and the orbiting lap 333 radially extend from the fixed shaft support portion 3281 because the rotary shaft 320 is arranged passing through the center of the fixed scroll 320. Accordingly, in the scroll compressor 10 of the present invention, the radius of the fixed lap 323 and the orbiting lap 333 is larger than in the conventional scroll compressor. As a result, forming the fixed lap 323 and the orbiting lap 333 according to the shape of the conventional scroll compressor may lower the compression ratio and have a risk of weakening and deforming the fixed lap 323 and the orbiting lap 333.

To address this issue in the scroll compressor 10 of the present invention, the fixed lap 323 and the orbiting lap 333 may be formed by a combination of a plurality of circular arcs whose curvature continuously changes. For example, the fixed lap 323 and the orbiting lap 333 may be provided as a hybrid lap formed by combining 20 or more circular arcs.

Even in this case, however, the discharge hole 326 cannot be positioned at the center of the lap because the rotary shaft 230 is arranged passing through the center of the fixed scroll 320,. Accordingly, the scroll compressor 10 of the present invention may be provided with discharge holes 326*a* and 326*b* in the inner circumferential surface and the outer circumferential surface of the center portion of the orbiting scroll lap, respectively (see FIG. 6).

During low load operation including partial load, he refrigerant may be excessively compressed in the space provided with the discharge holes 326*a* and 326*b*, thereby degrading efficiency. In this regard, a plurality of discharge holes may be further provided along the inner circumferential surface or the outer circumferential surface of the orbiting lap (a multi-stage discharge system)

The scroll compressor 10 of the present invention may not include a discharge valve for selectively blocking the plurality of discharge holes 326. This is intended to prevent hitting sound, which is generated when the discharge valve collides with the fixed scroll 320, from being generated.

Referring to FIG. 1(*b*), the compression unit 300 is fixed to the case 100, and the rotor 220 is separated from the state 210 so as to rotate. Accordingly, one end of the rotary shaft 230 that is coupled to the compression unit 300 may be supported, but the opposite end thereof coupled to the drive unit 200 may neither be fixed nor be supported. Accordingly, the one end of the rotary shaft 230 may be supported as a fixed end, but the opposite end is provided as a free end and is not supported. Therefore, the rotary shaft 230 may be supported inside the case 100 as a structure like a cantilever beam.

In this configuration, installing the balancer 400 on the drive unit 200 means that the load of the balancer 400 is further added to a portion by which the rotary shaft 230 is not supported. In other words, even if the load of the balancer 400 is arranged to compensate for the eccentricity of the eccentric shaft 232*b*, the load of the balancer 400 is added to the free end of the rotary shaft 230.

Therefore, the balancer 400 generates the bending moment on the rotary shaft 230. In addition, when the rotary shaft 230 rotates at a high speed, the balancer 400 acts as a cause of generating a greater bending moment and vibration.

Specifically, when the outer balancer 410 is installed, it may generate the greatest bending moment on the rotary shaft 230 because the outer balancer 410 is arranged farthest from the fixed end of the rotary shaft 230.

As a result, when the rotary shaft 230 rotates at a high speed at or above a predetermined level, an additional bending moment may be generated on the rotary shaft 230 due to the load of the balancer 400, and thus may bend the rotary shaft 230 at a predetermined angle.

In this case, a greater bending moment may be generated as the rotary shaft 230 rotates at a higher speed. Thus, as the rotor 220 and the stator 210 are closer to each other, they may cause friction or collide with each other. In addition, the rotary shaft 230 may be plastically deformed and completely bent.

Thereby, durability and stability of the scroll compressor 10 may be significantly reduced, or full performance may not be exhibited as the rotary shaft 230 is not allowed to be driven beyond a critical speed beyond which the rotary shaft 230 cannot withstand the bending moment generated by the balancer 400.

FIG. 2 shows the structure of the compressor 10 of the present invention which may address the aforementioned issue.

The compressor 10 of the present invention may have the same structure as the above-described scroll compressor except for the shape and the installation position of the balancer.

FIG. 2(*a*) shows the internal structure of the case 100 of the compressor 10, and FIG. 2(*b*) shows the structure of a shaft balancer 600 of the compressor 10.

Referring to FIG. 2(*a*), the balancer 400 of the compressor 10 may further include a shaft balancer 600 rotatably coupled to the rotary shaft 230 protruding from the compression unit 300 in a direction away from the discharge portion 121. The shaft balancer 600 may be arranged to offset the eccentric load of the eccentric shaft 232*b*.

The shaft balancer 600 may protrude from the compression unit 300 to the outside or downward so as to be coupled to the rotary shaft 230. The rotary shaft 230 may further include a balancer coupling portion 235, which may be coupled between the oil filter 233 and the main bearing portion 232*a* or determine the coupling position of the shaft balancer 600.

As a result, the shaft balancer 600 may not be coupled to the free end of the rotary shaft 230 coupled to the drive unit 200, but may be coupled in proximity to the fixed end of the rotary shaft 230 coupled to the compression unit 300.

Thus, the shaft balancer 600 may be positioned at a short distance from the fixed end and may not add a load to the free end of the rotary shaft 230 to which the driver 200 is coupled. In other words, the bending moment generated by the shaft balancer 600 may be less than the bending moments generated by the outer balancer 410 and the central balancer 420. In addition, even when the rotary shaft 230 rotates at a high speed, bending of the rotary shaft 230 may be prevented to a maximum degree.

In addition, the shaft balancer 600 is arranged on a side of the compression unit 300 opposite to the side on which the outer balancer 401 and the central balancer 420 are arranged. Accordingly, the shaft balancer 600 may be coupled to the compression unit 300 by a length corresponding to the length by which the central balancer 420 is spaced apart from the compression unit 300, or may be coupled while being spaced apart by a length less than the length by which the outer balancer 410 is spaced apart from the compression unit 300. As a result, the shaft balancer 600 may offset the eccentric load of the eccentric shaft 232*b* together with the central balancer 420 and the outer balancer 410 in a balanced manner.

Furthermore, since the shaft balancer 600 can sufficiently offset the load of the eccentric shaft 232*b* together with the central balancer 420, the outer balancer 410 may be omitted from the compressor 410.

Accordingly, the compressor 10 of the present invention may eliminate at least a part of the load added to the free end of the rotary shaft 230. Therefore, even when the rotary shaft 230 rotates at a high speed, the bending moment generated at the free end of the rotary shaft 230 may be minimized, and thus the rotary shaft 230 may be prevented from being bent.

In addition, as the outer balancer 410 is omitted, the gap between the drive unit 200 and the discharge portion 121 may be correspondingly narrowed. Therefore, the dead volume inside the case 100 may be greatly reduced, and thus the performance of the compressor 10 may be further improved.

As shown in FIG. 2, the shaft balancer 600 may be coupled to the rotary shaft 230 outside the muffler 500. Accordingly, the shaft balancer 600 may be prevented from contacting the refrigerant discharged from the compression unit 300. As a result, the rotary shaft 230 may be prevented from being bent without degrading the performance of the compressor 10.

Referring to FIG. 2(*b*), the shaft balancer 600 may include an eccentric portion 610 coupled to the rotary shaft 230 to rotate together with the rotary shaft 230.

The eccentric portion 610 may be formed in any shape as long as it can offset or compensate for the eccentric load of the eccentric shaft 232*b*. For example, the eccentric portion 610 may include a load portion 612 formed in a disk shape to minimize the rotational inertia I.

The load portion 612 may include a load body 612*a* defining a main body, a load through hole 612*b* through which the rotary shaft 230 is arranged to pass through the load body 612*a*, and a balancing portion 312 provided by cutting away or penetrating a part of the load body 612*a* corresponding to the eccentric shaft 232*b*, or concavely forming the part corresponding to the eccentric shaft 232*b* so as to be thin and generate an eccentric load on the load body 612*a*.

As a result, the balancing portion 612*d* may eccentrically dispose the load of the load body 612*a* to a side opposite to the side on which the load of the eccentric shaft 232*b* is disposed. Accordingly, when the eccentric portion 610 rotates, it may offset the eccentric moment of the eccentric shaft 232*b* by generating an eccentric moment opposed to that of the eccentric shaft 232*b*.

The eccentric portion 610 may be brought into contact with the oil stored in the lower portion of the case 100 or be submerged in the oil. In this case, it may collide with the oil to generate unnecessary resistance because the eccentric portion 610 is not a smooth or flat surface due to the balancing portion 612*d*.

In order to prevent such a collision, the shaft balancer 600 of the present invention may further include covers 611 and 613 to shield the balancing portion 612*d* to prevent the balance portion of 612*d* from being exposed to the outside.

The covers 611 and 613 may have a shape corresponding to the eccentric portion 610, and may be coupled to one surface or both surfaces of the eccentric portion 610 to shield the balancing portion 612*b*.

Accordingly, even when the surface of the load body 612*a* is not smooth due to the balancing portion 612*d*, the covers 611 and 613 may produce the same effect as obtained when the surface of the eccentric part 610 is flat. Therefore, friction between the eccentric portion 610 and the fluid may be minimized.

When the balancing portion 612*d* is concavely formed on one surface of the load body 612*a*, only one cover 611, 613 may be provided so as to be coupled to the one surface provided with the balancing portion 612*d*. When the balancing portion 612*d* is provided by cutting away or penetrating the load body 612*a*, the covers 611 and 613 may include an inner cover 611 coupled to one surface of the load body 612 and an outer cover 613 coupled to an opposite surface of the load body 612*a*.

The inner cover 611 may include an inner cover body 611*a* having an area corresponding to the outer circumferential surface of the load portion 612, and an inner through hole 611*b* formed through the cover body and coupled to the rotary shaft. The outer cover 613 may include an outer cover body 613*a* having an area corresponding to the outer circumferential surface of the load portion 612, and an outer through hole 613*b* formed through the outer cover body and coupled to the rotary shaft. The inner cover body 611*a* and the outer cover body 613*a* may be arranged to define the opposite surface of the eccentric portion 610 to shield the balancing portion 612.

The load portion 612 and the covers 611 and 613 may further include coupling portions coupled to each other. The coupling portions may be coupled by a separate coupling member, or may have a structure such as a hook or the like and thus be engaged with or detachably coupled to each other.

For example, at least one body coupling portion 612*c* to which a separate bolt can be inserted so as to be coupled therewith may be provided on the outer circumferential surface of the load body 612*a*, and the inner cover 611 may include an inner coupling portion 611*c* provided at a position corresponding to the body coupling portion 612*c* such that the bolt can be inserted thereinto so as to be coupled. In addition, the outer cover 613 include an outer coupling portion 613*c* provided at a position corresponding to the body coupling portion 612*c* such that the bolt can be inserted thereinto so as to be coupled. Accordingly, the inner coupling portion 611*c*, the body coupling portion 612*c*, and the outer coupling portion 613*c* may be firmly coupled together with one bolt.

FIG. 3 illustrates embodiments in which the shaft balancer 600 of the compressor 10 of the present invention can minimize resistance against a fluid occurring due to viscosity of the fluid.

Since the shaft balancer 600 of the compressor 10 is arranged to be exposed to the outside of the compression unit 300, a part of the shaft balancer 600 may be exposed to the oil stored in the case 100. Further, when the discharge portion 121 is arranged above the compression unit 300, the shaft balancer 600 may be at least partially submerged in the oil stored in the lower portion of the case 100. In addition, the shaft balancer 600 may be contact various kinds of fluids including air in the case 100.

When the rotary shaft 230 rotates at a high speed with the shaft balancer 600 contacting a fluid such as the oil or air, considerable energy loss may take place due to the shaft balancer 600 and the resistance caused by viscosity of the fluid, and vortex of the oil.

Accordingly, the compressor 10 of the present invention may accommodate at least a part of the shaft balancer 600 through the muffler 500 to prevent at least a part of the outer circumferential surface of the shaft balancer from being exposed.

That is, the muffler 500 may be arranged to accommodate the eccentric portion 610 to prevent the outer circumferential surface of the eccentric portion 610 from being exposed to the outside.

Specifically, the muffler 500 may include a coupling portion 520 coupled to the fixed scroll, an accommodation body 510 extending from the coupling portion to define a space allowing the refrigerant to flow therein, and a recess 540 formed on one surface of the accommodation body 510 so as to be concave toward the discharge portion.

In an embodiment, the muffler 500 may further include an extended portion extending from the outer circumferential surface of the recess 540 to shield the outer circumferential surface of the shaft balancer 600, and a muffler shaft support portion 541 configure to rotatably support the rotary shaft 230 on the inner circumferential surface of the recess 540. The extended portion 530 may be regarded as an exposed surface of the accommodation body 510 spaced farthest from the discharge portion 121.

The recess 540 may have a shape corresponding to the shaft balancer 600. Specifically, the recess 540 may have a diameter corresponding to the outer circumferential surface of the eccentric portion 610 or larger than the diameter of the outer circumferential surface, and a depth corresponding to the total thickness of the eccentric portion 610 and the covers 611 and 613 or greater than the total thickness.

As such, the shaft balancer 600 may be accommodated in the recess 540. The extended portion 530 of the accommodation body 510 and the exposed surface of the shaft balancer 600 may be arranged parallel to each other. This is intended to prevent the fluid such as the oil from colliding or interfering with any one of the extended portion 530 and the shaft balancer 600.

As a result, when the rotary shaft 230 rotates, the eccentric portion 610 rotates together with the rotary shaft 230, but the recess 540 is fixed. Therefore, even when the eccentric portion 610 rotates at a high speed, the degree of contact between the outer circumferential surface of the eccentric portion 610 and the oil may be very small, and accordingly the viscous resistance is reduced or unnecessary vortex may be prevented from being generated in the stored oil.

FIG. 4 illustrates other embodiments in which the shaft balancer 600 of the compressor 10 of the present invention can minimize resistance against a fluid occurring due to viscosity of the fluid. Specifically, FIG. 4(*a*) illustrates an embodiment in which the shaft balancer 600 includes a housing 620 arranged spaced apart from the muffler 500 to prevent the eccentric portion 610 from being exposed. FIGS. 4(*b*), 4(*c*), and 4(*d*) illustrate various embodiments of the housing 620.

Referring to FIG. 4(*a*), the shaft balancer 600 may further include a housing 620 coupled to the rotary shaft 230 so as to accommodate the eccentric portion 610. The housing 620 may completely accommodate the eccentric portion 610, thereby completely blocking the eccentric portion 610 from contacting the refrigerant or the oil.

Here, the housing 620 may be arranging to rotate separately from the rotary shaft 230 when the rotary shaft 230 is rotated, or may be coupled to the rotary shaft 230 such that the housing is prevented from rotating together with the rotary shaft 230. Accordingly, the housing 620 may be prevented from causing viscously friction against the oil or generating a vortex in the oil.

Referring to FIG. 4(*b*), the housing 620 may include a housing body 621 configured to completely accommodate the eccentric portion 610, and a housing shaft support portion 622 provided to the housing body to surround the outer circumferential surface of the rotary shaft 230, the housing shaft support portion 622 and the rotary shaft 230 being prevented from rotating simultaneously.

The housing shaft support portion 622 may be provided only to the top of the housing body 621 or to both the top and the bottom thereof. In addition, the housing shaft support portion 622 may extend from the housing body 621 of the rotary shaft 230 to accommodate the rotary shaft 230, or may be provided as a through hole formed in the housing body 621 in a penetrated manner to allow the rotary shaft 230 to be arranged therethrough.

The inner circumferential surface of the housing body 621 may be spaced apart from the outer circumferential surface of the eccentric portion 610 by a predetermined distance, and thus the eccentric portion 610 may be allowed to freely rotate without contacting the housing body 621. In addition, the housing shaft support portion 622 may have a larger diameter than the rotary shaft 230. In addition, the housing shaft support portion 622 may be fixed to the muffler shaft support portion 541 or the fixed shaft support portion of the fixed scroll 330 and thus be prevented from rotating. Therefore, when the rotary shaft 230 and the eccentric portion 610 rotate together, the housing 620 may be prevented from rotating. Thereby, energy loss caused by viscous resistance or the like may be minimized.

Referring to FIG. 4(*c*), the housing 620 may be coupled to the rotary shaft 230 through a rotational bearing 623. The rotational bearing 623 may be arranged on the inner circumferential surface of a rotary shaft support portion 621 and the outer circumferential surface of the balancer coupling portion 235 of the rotary shaft 230 to couple the rotary shaft support portion 621 to the rotary shaft 230. Furthermore, the rotational bearing 623 may support the rotary shaft support portion 623 and the rotary shaft 230 such that the rotary shaft support portion 623 and the rotary shaft 230 can make a relative rotation with respect to each other.

Accordingly, when the housing 620 weighs relatively much, inertial force may prevent the housing 620 from rotating when the rotary shaft 230 rotates.

Referring to FIG. 4(*d*), the housing 620 may be supported by a separate coupling ring 624 coupled to the rotary shaft.

The coupling ring 624 may be coupled to the outer circumferential surface of the rotary shaft 230 to support the housing body 621 or the housing shaft support portion 622. That is, the coupling ring 624 may determine the installation position of the housing 620 on the rotary shaft 230.

Here, the coupling ring 624 to be formed of a self-lubricative material so as to cause very little friction against the housing 620. Therefore, when the coupling ring 624 is rotated by rotation of the rotary shaft 230, the housing 620 supported by the coupling ring 624 may be prevented from rotating together with the rotary shaft 230 due to its own weight and inertial force.

Specifically, the balancer coupling portion 235 of the rotary shaft 230 may include a contact portion 235*a* positioned on the inner circumferential surface of the housing shaft support portion 622, and a recess portion 235*b* provided to at least one of an upper portion and a lower portion of the contact portion, the recess portion having a smaller diameter than the contact portion. The coupling ring 624 may be fitted into the recess portion 235*b*. The inner circumferential surface of the coupling ring 624 may be arranged to contact the recess portion 235*b*, and the outer circumferential surface thereof may be arranged to support the housing 620.

FIG. 5 shows another embodiment of the shaft balancer 600 according to the present invention.

Referring to FIG. 5, the shaft balancer 600 of the present invention may be completely accommodated in the muffler 500 and thus be blocked from contacting the oil stored in the case 100. In other words, the shaft balancer 600 may be arranged such that the eccentric portion 610 is completely accommodated in the muffler 500. Accordingly, the structure of the housing 620 may be omitted.

Here, i the outer circumferential surface of the eccentric portion 610 and the inner circumferential surface of the accommodation body 510 may be spaced apart from each other. In other words, the eccentric portion 610 may be arranged to rotate in the inner space of the muffler 500 while being prevented from causing friction.

The accommodation body 510 of the muffler may be further expanded as much as the inner volume reduced in the muffler 500 due to the eccentric portion 610.

As such, in the compressor 10 of the present invention, the shaft balancer 600 is arranged at a separated place on a side of the compression unit 300 facing away from the discharge portion 121, the rotary shaft 230 may be prevented from being bent by the balancer 400.

Furthermore, the compressor 10 of the present invention may prevent the shaft balancer 600 from contacting or storing the refrigerant or fluid even if the shaft balancer 600 is installed outside the compression unit 300. Thereby, the performance of the compressor 10 may be maintained.

Hereinafter, the principle of operation of the scroll compressor 10 according to the present invention will be described with reference to FIG. 6.

FIG. 6(*a*) shows an orbiting scroll, FIG. 6(*b*) shows a fixed scroll, and FIG. 6(*c*) shows a process in which the orbiting scroll and the fixed scroll compress the refrigerant.

The orbiting scroll 330 may include the orbiting lap 333 formed on one surface of the orbiting head plate 331 and the fixed scroll 320 may include the fixed lap 323 formed on one surface of the fixed head plate 321.

The orbiting scroll 330 may be formed as a rigid body which is sealed to prevent the refrigerant from being discharged to the outside, but the fixed scroll 320 may include an introduction hole 325 communicating with a refrigerant supply pipe to allow introduction of a low-temperature and low-pressure refrigerant in a liquid state or the like, and a discharge hole 326 through which the high-temperature and high-pressure refrigerant is discharged. A bypass hole 327 through which the refrigerant discharged from the discharge hole 326 is discharged may be formed in the outer circumferential surface of the fixed scroll 320.

The fixed lap 323 and the orbiting lap 333 may be formed in an involute shape so as to form a compression chamber in which the refrigerant is compressed, as the laps are engaged with each other at at least two points.

The involute shape refers to a curve corresponding to a trajectory of an end of a thread wound around a base circle having an arbitrary radius that is formed when the thread is released, as shown in the drawing.

However, the fixed lap 323 and the orbiting lap 333 of the present invention are formed by combining 20 or more circular arcs, and thus the radius of curvature may vary among the parts of the laps.

That is, in the compressor of the present invention, the rotary shaft 230 is arranged to extend through the fixed scroll 320 and the orbiting scroll 330, and thus the radius of curvature and the compression space of the fixed lap 323 and the orbiting lap 333 are reduced.

Accordingly, in order to compensate for the reduction, the compressor of the present invention has a structure in which the space through which the refrigerant is discharged is narrowed. In addition, the radius of curvature of the fixed lap 323 and the orbiting lap 333 immediately before discharging is reduced below the radius of the penetrated shaft support portion of the rotary shaft to improve a compression ratio.

That is, the fixed lap 323 and the orbiting lap 333 may be bent to a larger extent near the discharge hole 326, and the radius of curvature of the laps may vary from point to point according to the curved parts as the laps extend toward the introduction hole 325.

Referring to FIG. 6(*a*), a refrigerant I flows into the introduction hole 325 of the fixed scroll 320 and the refrigerant II introduced before the refrigerant I flows into the fixed scroll 320 is located in the vicinity of the discharge hole 326.

At this time, the refrigerant I is present in an area where the rotating lap 333 is engaged with the outer surface of the fixed lap 323, and the refrigerant II is sealed in another area where the fixed lap 323 is engaged with the orbiting lap 333 at two points.

Then, when the orbiting scroll 330 starts to make an orbiting movement thereafter, the area where the fixed lap 323 is engaged with the orbiting lap 333 at two points is moved along the extension direction of the orbiting lap 333 according to change in position of the orbiting lap 333. Thereby, the volume is starts to be reduced, and the refrigerant I moves and starts to be compressed. The refrigerant II starts to be compressed and guided to the discharge hole 327 as the volume thereof is further reduced.

The refrigerant II is discharged from the discharge hole 327, and the refrigerant I moves and starts to be further compressed along with reduction of the volume thereof as the area where the fixed lap 323 is engaged with the orbiting lap 333 at two points moves clockwise.

As the area where the fixed lap 323 is engaged with the orbiting lap 333 at two points moves further clockwise, the area is positioned closer to the inside of the fixed scroll, the refrigerant (II) is compressed with the volume further reduced and is almost completely discharged.

As described above, as the orbiting scroll 330 makes an orbiting movement, the refrigerant may be linearly or continuously compressed while moving into the fixed scroll.

Although the refrigerant is illustrated in the figures as non-continuously flowing into the introduction hole 325, this is merely an example. The refrigerant may be continuously supplied, and may be accommodated and compressed in each area where the fixed lap 323 is engaged with the orbiting lap 333 at two points.

MODE FOR THE INVENTION

Various embodiments have been described in the best mode for carrying out the invention.

It will be apparent to those skilled in the art that various modifications and variations can be made in the present invention without departing from the spirit and scope of the invention. Thus, it is intended that the present invention cover the modifications and variations of this invention provided they come within the scope of the appended claims and their equivalents.

The invention claimed is:

1. A compressor comprising:

a case comprising a discharge portion that is disposed at one side of the case and configured to discharge a refrigerant;

a drive unit comprising:

a stator coupled to an inner circumferential surface of the case and configured to generate a magnetic field, and a rotor accommodated in the stator and configured to be rotated based on the magnetic field;

a rotary shaft that extends through the rotor in a direction away from the discharge portion, the rotary shaft comprising an eccentric shaft that is arranged at one side of the rotary shaft and arranged thickly toward a part of the inner circumferential surface of the case;

a compression unit comprising:

an orbiting scroll coupled to the eccentric shaft and configured to perform an orbital movement based on rotation of the rotary shaft, and a fixed scroll engaged with the orbiting scroll, the fixed scroll being configured to receive and compress the refrigerant;

a muffler coupled to the compression unit, the muffler being configured to guide the refrigerant to the discharge portion; and a balancer coupled to at least one of the drive unit or the rotary shaft, the balancer being configured to offset or distribute a load of the eccentric shaft, wherein the balancer comprises a shaft balancer that is rotatably coupled to the rotary shaft protruding from the compression unit in the direction away from the discharge portion, wherein the shaft balancer further comprises:

an eccentric portion coupled to the rotary shaft and configured to rotate together with the rotary shaft, and a housing that is coupled to the rotary shaft and accommodates the eccentric portion, and wherein the housing is configured to rotate in a direction opposite to a rotation direction of the rotary shaft.

2. The compressor of claim 1, wherein the eccentric portion comprises a load body having a plate shape, the load body defining:

a load through hole that penetrates through the load body and is coupled to the rotary shaft; and a balancing portion recessed from a part of the load body.

3. The compressor of claim 2, further comprising a cover that is coupled to the load body and covers the balancing portion.

4. The compressor of claim 1, wherein the housing comprises:

a housing body that accommodates an entirety of the eccentric portion;

a housing shaft support portion that is disposed at the housing body and surrounds an outer circumferential surface of the rotary shaft, wherein the housing shaft support portion and the rotary shaft are configured to rotate individually.

5. The compressor of claim 4, wherein the housing shaft support portion is fixed to the muffler or the fixed scroll.

6. The compressor of claim 4, wherein the rotary shaft comprises:

a contact portion that faces an inner circumferential surface of the housing shaft support portion;

a recess portion disposed at at least one of an upper portion of the contact portion or a lower portion of the contact portion, wherein a diameter of the recess portion is less than a diameter of the contact portion; and a coupling ring coupled to the recess portion and configured to restrict an axial movement of the housing shaft support portion.

7. The compressor of claim 6, wherein the coupling ring includes a self-lubricative material.

8. The compressor of claim 4, further comprising:

a rotational bearing arranged between the housing shaft support portion and the rotary shaft and configured to rotatably support the rotary shaft.

9. The compressor of claim 4, wherein the rotary shaft comprises:

a contact portion that faces an inner circumferential surface of the housing shaft support portion;

an upper recess portion defined at an upper portion of the contact portion;

a lower recess portion defined at a lower portion of the contact portion and spaced apart from the upper recess portion in an axial direction of the rotary shaft, wherein a diameter of each of the upper recess portion and the lower recess portion is less than a diameter of the contact portion;

an upper coupling ring coupled to the upper recess portion; and a lower coupling ring coupled to the lower recess portion, and wherein the upper coupling ring and the lower coupling ring are configured to restrict movement of the housing shaft support portion in the axial direction.

10. The compressor of claim 9, wherein a diameter of each of the upper coupling ring and the lower coupling ring is greater than a diameter of the housing shaft support portion.

11. The compressor of claim 9, wherein the upper coupling ring overlaps with the housing shaft support portion, and the lower coupling ring overlaps with the housing body.

* * * * *